US009322129B2

(12) United States Patent
Wadhwa et al.

(10) Patent No.: US 9,322,129 B2
(45) Date of Patent: Apr. 26, 2016

(54) GARMENT TREATMENT STAND

(71) Applicant: KONINKLIJKE PHILIPS N.V., Eindhoven (NL)

(72) Inventors: Sahil Wadhwa, Singapore (SG); Yong Jiang, Singapore (SG); Asok Kumar Kasevan, Johor (MY); Mirjam Christiana Albrecht Van Coillie, Amersfoort (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/403,619

(22) PCT Filed: May 22, 2013

(86) PCT No.: PCT/IB2013/054222

§ 371 (c)(1),
(2) Date: Nov. 25, 2014

(87) PCT Pub. No.: WO2013/179184

PCT Pub. Date: Dec. 5, 2013

(65) Prior Publication Data

US 2015/0122848 A1 May 7, 2015

Related U.S. Application Data

(60) Provisional application No. 61/652,363, filed on May 29, 2012.

(51) Int. Cl.

| | |
|---|---|
| ***D06F 73/00*** | (2006.01) |
| ***D06F 71/40*** | (2006.01) |
| ***D06C 5/00*** | (2006.01) |

(52) U.S. Cl.
CPC *D06F 73/00* (2013.01); *D06C 5/00* (2013.01); *D06F 71/40* (2013.01)

(58) Field of Classification Search
CPC ..... D06F 73/00; D06F 71/18; D06F 71/40; D06F 59/00; A41H 5/00; A41H 5/02; A47F 8/00; D06C 5/005; D06C 5/00; D06C 15/00
See application file for complete search history.

(56) References Cited

U.S. PATENT DOCUMENTS

| | | | | |
|---|---|---|---|---|
| 2,460,732 | A * | 2/1949 | Brenner | D06F 73/00 223/67 |
| 2,969,897 | A | 1/1961 | Paris | |
| 3,066,839 | A * | 12/1962 | Dosal | D06F 73/00 223/67 |
| 3,262,615 | A * | 7/1966 | Killey | D06F 73/00 223/67 |
| 3,326,427 | A * | 6/1967 | Schlemon | D06F 71/16 223/67 |

(Continued)

FOREIGN PATENT DOCUMENTS

| | | | |
|---|---|---|---|
| DE | 102006002651 | A1 | 8/2007 |
| EP | 2586908 | A1 | 5/2013 |
| GB | 665353 | | 1/1952 |
| WO | 9518257 | A1 | 7/1995 |

*Primary Examiner* — Ismael Izaguirre

(57) ABSTRACT

The invention provides a garment treatment stand (1) for garment treatment, the garment treatment stand (1) comprising:—a open frame (2);—a flexible support surface (3), in use stretched up tautly on said frame (2) for providing a surface for pressing against during garment treatment. The current invention adds a flexible steaming/ironing surface to a garment treatment stand, to allow for it to be used as a support during steaming/ironing of the garment. Especially, the garment treatment stand may be used for steaming or pressing garments.

14 Claims, 4 Drawing Sheets

(56) References Cited

U.S. PATENT DOCUMENTS 3,385,485 A * 5/1968 Aloi ..... D06F 73/00 223/70
3,568,900 A * 3/1971 Paris ..... D06F 73/00 223/70
4,304,183 A * 12/1981 Loria ..... B41M 1/12 101/119
7,409,786 B2 8/2008 Lee
2003/0226863 A1 * 12/2003 Hickle ..... D06F 73/00 223/57
2004/0221472 A1 11/2004 Damrath
2009/0241614 A1 10/2009 Hahn
2009/0255302 A1 10/2009 Haan
2011/0030249 A1 2/2011 Rosenzweig

* cited by examiner

GARMENT TREATMENT STAND

CROSS-REFERENCE TO PRIOR APPLICATIONS

This application is the U.S. National Phase application under 35 U.S.C. §371 of International Application No. PCT/IB2013/054222, filed on May 22, 2013, which claims the benefit of U.S. Provisional Patent Application No. 61/652363, filed on May 29, 2012. These applications are hereby incorporated by reference herein.

FIELD OF THE INVENTION

The invention relates to a garment treatment stand.

BACKGROUND OF THE INVENTION

Garment steamers in general are known in the art. Often, they comprise some means of holding up clothes.

US2009/0255302, for instance, discloses a garment steamer for uncrumpling clothing such as trousers, jackets, one-piece, or the like while emitting steam, more particularly, to a garment steamer having a grabbing means capable of stretching trousers. To that end, it is provided with a pole having a hanger at one end.

US2009/0241614 discloses a steam ironing appliance having a base enclosing a steam generator. It comprises a handle structure composed of a handle in the form of a coat hanger resting on two telescoping poles. The telescoping poles comprise a locking device. The poles having at least one moveable section slideably mounted in a guide member having at least one opening. The locking device includes a body fixed to the movable section, a locking member carried by the body and movable between locking an unlocking positions, a rotatable lever carried by the body and pivotable between a release position, in which relative movement is permitted between the movable section and the guide member, and a blocking position, in which the lever comes to bear on the guide member and exerts a force assuring a transverse immobilization of the moveable section in the guide member. The lever is coupled to the locking member to be displaced toward the blocking position when the locking member is engaged in the opening under the force produced by a restoring element. Garments can be placed on the extended handle when said treated using said steam ironing appliance.

SUMMARY OF THE INVENTION

In general, garment steamers can be classified as stand steamers, portable steamers and handheld steamers. As a product group, their primary objective is to provide sufficient steam to treat a—in general—vertically hung garment. Stand steamers may offer an extendable rod with a hanger on top for the user to hang their garment and steam it. The current invention deals with some of the limitations/problems of especially such stand designs for garment steamers available in the market, and aims to improve upon them.

Current garment stand steamers, even if they have a hot surface like an ironing plate on the steamer head surface, usually do not include a flat surface in the hanger stand, against which the garment may be pressed. This hampers the usage of the steaming surface/hot ironing plate as a light iron for additional pressing of the tough wrinkles/pleats in the garment. Furthermore, current stand steamers are mainly concentrated towards providing a hanger for shirts or tops, but not trousers/skirts etc. Even if stand steamers provide clips to suspend trousers from the hanger, steaming can only be used to take care of wrinkles on the outer seams of the trouser. Due to the lack of any stress introduction to the fabric, it is hardly effective. Furthermore, stand steamers often have a single pole that allows for the hanger mounted upon it to swivel along its midpoint and allow users to manoeuvre the garment during steaming. However, a single pole design may make most stands less stable for steaming.

Hence, it is an aspect of the invention to provide an alternative garment treatment stand, which preferably further at least partly obviates one or more of above-described drawbacks.

Furthermore, or alternatively, in an aspect of the invention a garment treatment stand is provided that is easy to use and provides better ironing/pressing/steaming results.

The invention thus provides a garment treatment stand for garment treatment, the garment treatment stand comprising an open frame, and a flexible support surface (further also indicated as "support surface"). Especially, the flexible support surface, is configured to be stretched up tautly on the open frame during use of the garment treatment stand. Hence, the invention especially provides a garment treatment stand for garment treatment, the garment treatment stand comprising an open frame, and a flexible support surface in use stretched up tautly on said open frame for providing a surface for pressing against during garment treatment. Hence, the garment treatment stand is especially configured to allow the flexible support surface be stretched up tautly on said open frame for providing a surface for pressing against during garment treatment (during use of the garment treatment stand).

Herein, the term "garment treatment" especially refers to dewrinkling using steam, especially via steaming. The "garment treatment stand" is herein also indicated as "treatment stand", "steamer stand", or simply as "stand". The "flexible support surface" is also indicated as "support surface".

The garment treatment stand may comprise a garment treatment device. Such a garment treatment device comprises for instance a steamer.

In an embodiment, the frame is an open frame. An open frame is thus configured to hold up the support surface ("stretched up tautly"). In an embodiment, it allows steam to pass through the support surface and prevents it to (substantially) condense and make the garment wet.

The support surface may help to achieve better garment treatment results. The surface allows applying increased pressure to the garment in order to remove wrinkles. Thus, the steamer may even be combined with a hot or heated ironing surface for de-wrinkling garment. In this respect, an open frame leaves the area of the support surface as much as possible open. In an embodiment, the open frame leaves the area of the support surface open for at least 50% of that area. In an embodiment, it may even leave that area open for at least 90%. An advantage of the open frame may thus be that when applying pressure to the garment on the support surface, the support surface may due to its flexibility deform elastically (i.e., non-permanently) when a force is applied, but substantially without touching resilient material, as would be the case with a closed frame. This does however not exclude that the open frame may comprise one or more crossing bars spanning the open area within the open frame (see also below).

The open frame can for instance comprise a peripheral frame, for instance composed of tubes having a tubular or channel cross-sections. It may include some reinforcement elements crossing the area of the support surface. Thus, in an embodiment, the open frame can be rectangular, O-shaped, U-shaped, or even H-shaped. To make the open frame easy to handle, it can be a light-weight open frame. In an embodiment, at a large portion of the area of the support surface the open frame is thus hollow, leaving much of the support surface free (especially at least 50% of that area. In an embodiment, it may even leave that area open for at least 90%, see also above).

The current invention adds a flexible steaming/ironing surface to a garment treatment stand, to allow for it to be used as a support during steaming/ironing of the garment. Especially, the garment treatment stand may be used for steaming or pressing garments.

In an embodiment, the open frame is coupled to a base. This may especially give the garment treatment stand stability (during use when applying pressure to the flexible surface). In an embodiment, the open frame is adjustably coupled to said base, especially for allowing said support surface to be positioned, in use, vertically, horizontally, or an angle in between, with respect to a floor. In this way, a versatile use is provided. In an embodiment, the said coupling is hingingly, for instance via a hinge.

In an embodiment, the base is moveable, allowing it to be easily displaced from one place to another. In an embodiment, the base can be provided with wheels to allow the garment treatment stand to be easily moveable from one place to another. Using brakes or by collapsing the wheels, the stand can be firmly positioned for use.

In an embodiment, the open frame comprises a peripheral frame. Said support surface may comprise an envelope of flexible material, (which may in use be) stretched over said peripheral frame. In an embodiment that may combine said peripheral frame, the garment treatment stand comprises a base frame coupled to said base and hingingly coupled to said peripheral frame. The peripheral frame may especially allow said support surface to be positioned, in use, vertically, horizontally, or an angle in between, with respect to a floor.

Thus, a garment stand is provided with many uses, and which can be stored easily.

In an embodiment, the flexible support surface comprises at least one porous layer. Such a layer may for instance comprise or consist of a polymer foam layer that is at least partially stem permeable or which bounces back steam. Such a layer can be light weight, and easy to handle.

In an embodiment, the flexible support is (at least partly) steam permeable. In this way, condensation of steam and wetting of garment is prevented.

In an embodiment, the support surface can be detached or removed from the open frame. Hence, in an embodiment, the support surface is detachable or removable from the open frame. Thus, in a specific embodiment, the support surface can be stowed in a storage provided on the garment treatment stand. Hence, in an embodiment the support surface is stowable or pliable. In an embodiment where the garment treatment stand comprises a base, the storage may be provided in said base. The storage may also be provided at an other end of the stand. Hence, the support surface is especially configured to be detachable to the support frame, thereby allowing during non-use to be stowed, e.g. in a storage. When needed, after the garment treatment stand is placed, the support surface can be mounted to the open frame.

The garment treatment stand of the invention, however, can provide a hanger for, for instance shirts or tops, but also for trousers/skirts and the like. It can also be provided with clips to suspend for instance trousers from the stand. The support surface allows providing additional pressure on the garment in order to take care of wrinkles on the outer seams of for instance the trouser. The support surface allows applying of stress introduction to the fabric of the garment.

The support surface can for instance be a mesh-like material, for instance a nylon mesh or a mesh from a polymer or polymer fiber material having open cells or open structure. In an embodiment, the material of the support surface is supple or pliable. Thus, it can be stored easily. In an embodiment, the material of the support surface is stretchable. It may even be a little elastic. Thus, often it is mounted on the open frame, stretched in a taut manner. Often, it is stretched almost to the end of its elastic stretching limit.

In an embodiment, the support surface is provided by a 3D fabric. 3D fabric is a fabric which consists of an open cell matrix of fibers, giving the fabric a thickness apart from a length and breadth. More importantly, an advantage of a 3D fabric is that it does not (substantially) trap steam, but may even recirculate part of the steam back into the fabric depending on the structure and optimization of the cells. The open cell structure also makes the support surface conducive to less condensation. It thus does not provide a surface for condensation and due to lack of natural absorbing fibers/capillary action between them, any condensed water gets absorbed to a lesser extent. This in particular is the case in the current invention, where this material is mounted almost free-standing on the open frame, allowing steam penetrating and passing though the material without condensing.

In an embodiment, said support surface is selected from the group consisting of a 3D fabric and an open cell material. This material allows steam to penetrate the support surface and prevents the steam from condensing and making the garment wet during treatment. In an embodiment, the 3D fabric comprises two or more (textile) wire mesh layers, arranged over each other and arranged with gauze openings shifted relative to each other. In an embodiment, the two layers are interconnected. When the gauze openings are shifted relative to each other, the gauze openings are not directly in line with each other. Especially, the 3D fabric comprises 2-5 (textile) wire mesh layers, such as 3 (textile) wire mesh layers. As indicated above, such 3D fabric and an open cell material may provide a flexible support surface The 3D fabric may in an embodiment be a kind of porous layer, which is made of porous material that allows heat and steam to pass through. It is able to reflect some amount of steam back to the garment being steam treated so that enhances moistening of garment from bottom side to ease the removal of wrinkles.

"Porous" in this respect can be defined as an open-cell structure, different from a closed-cell structure, permeable to steam and heat, and allowing steam and heat to pass through and at least partially reflect back. The pore size of the porous material used is in an embodiment adapted to cause only a limited compression and dimensional change, even after prolonged use. Hence, as also further indicated below, in an embodiment, the flexible support surface is at least partially steam reflecting.

In general, the 3D fabric, can have a thickness of more than 1 mm. An advantage of 3D fabric is that it can reduce a heat build-up, allows a consistent air circulation and provides a good steam transfer. Additional benefits include comfort cushioning experience. Known 3D fabrics are, normally, three-dimensional fabrics with an open-cell structure consisting of porous interlaced layers.

3D fabric can also be built in such a way that the pore size on one surface side is smaller than the pore size in body and the other surface side.

The porous layer preferably comprises a 3D fabric or a similar open cell structure foam. These materials have shown to enable a good steam and heat transfer through the material and at the same time a good heat and steam reflection on the intersections with the pores. Especially preferred is the usage of 3D fabric, since a 3D fabric has the additional benefit of being able to absorb moisture. In this way, condensed steam can be effectively absorbed within the inside of the porous layer. Besides that, a 3D fabric reduces a heat build-up, allows a consistent air circulation and provides a good steam transfer. Additional benefits include comfort cushioning and shock-absorbency with excellent recovery properties. Known 3D fabrics are, for example, Spacetec® 3D fabric. These fabrics are three-dimensional fabrics with an open-cell structure consisting of porous interlaced layers. In an embodiment, 3D fabric can also be built in such a way that the pore size on the one surface is smaller than the pore size in body and is comparable to the size of the conventional polyurethane foam The porous layer used according to the present invention preferably has a pore size that allows steam to flow through and reflect back freely, without causing too much compression set and dimensional change after prolong use.

The (flexible) support surface can further comprise a cover layer, for instance a cotton or other, similar, fabric. The cover layer can cover for instance the 3D fabric.

In an embodiment, the support surface comprises a strip of steam permeable material, at one end mounted on a roll provided at an end of said open frame and configured to be wound around said roll in a non-extended state and to be at least partially unwound from the roll in an extended state extending to an opposite end of said open frame. This steam permeable material can for instance consist of or comprise the material described above, like the 3D material. With this roll, the garment treatment stand can be stowed away and stored easily, and is ready for use just as easy. The strip can be pulled up (or down from the top part of the stand) to unfold it and anchor it to the top part of the garment treatment stand (or the base, respectively). This serves as a surface for pressing against, during garment treatment, like steaming/ironing. In an embodiment, the same strip can be pulled sideways from one longitudinal side of the open frame to unfold it and anchor it to the opposite side of the open frame.

In an embodiment, said roll is spring-biased to wind said support surface on said roll when said support surface is released from said open frame. This makes the support surface even easier to remove and to stow away.

In an embodiment, said roll is coupled to said open frame. In some embodiments the roll may be coupled to an end of said open frame. Hence, in an embodiment, the roll is provided at an end of said open frame, but in other embodiments, the roll may be provided at a base of the garment treatment stand, see also below.

In an embodiment, said support surface comprises attachment provisions for attaching the support surface to said open frame. Especially, in an embodiment, at its opposite end said support surface comprises attachment provisions for attaching the strip of steam permeable material to said open frame.

In an embodiment, said strip of steam permeable material has longitudinal sides, and at its longitudinal sides said strip of steam permeable material is provided with further attachment provisions for attaching said strip of steam permeable material in a stretched manner to said open frame.

In an embodiment, said open frame is collapsible. This makes the garment treatment stand even more easy to use. The garment treatment stand can thus be stowed away in a more compact state. In particular when combined with the support surface provided on a roll, this provides a very compact garment treatment stand.

In an embodiment, the garment treatment stand comprises a base coupled to said open frame. The base allows the open frame to be positioned in a position in which it can be used. This can be in a vertical position. Also, positioning of the support surface at an angle with respect to a horizontal floor may be possible when using the garment treatment stand. Alternatively or additionally, horizontal positioning of the support surface is possible. To this end, the garment treatment stand and/or the open frame may comprise one or more tilting elements, configured to tilt the open frame in a horizontal position. In this way, steaming, pressing and ironing may be performed on a horizontal support surface providing a tautly stretched, steam permeable support surface.

In an embodiment, the base is attached at a base end of said open frame for positioning said open frame vertically on a floor, and a garment holder is attached at an opposite garment holder end of said open frame. Thus, garment can be held in place and pressed against the support surface to provide an even better treatment.

In an embodiment, said support surface extends between the base and the garment holder end of said open frame. In this way, a large surface is provided for treating the garment.

In an embodiment, the open frame is provided for holding up the support surface at its support surface circumference. In an embodiment, said frame comprises a frame with said support surface fitted in or around said frame. In an embodiment, said support surface is at least partially fitted in or around said frame. In an embodiment said open frame may comprise a rectangular tubular frame with said support surface fitted in or around said rectangular tubular frame. This allows a relatively simple construction and a support surface material that can be stretched in a taut manner.

In an embodiment, said support surface is a textile layer. Providing the support surface as a textile layer makes it possible to easily store the support surface when not in use.

In an embodiment, the garment treatment stand further comprising a garment treatment device integrated. In some embodiments the garment treatment device may be integrated in a base of said open frame. Integrating the garment treatment device in a base of the garment treatment stand, and providing the support surface makes the garment treatment stand easy to use. Especially, the base may include a water tank. Thus, weight can be provided at a (in operation) low position.

In an embodiment, said open frame is collapsible. It may comprise a substantially rectangular open frame, and wherein said support surface is configured to be extendable within said substantially rectangular open frame. Thus, the open frame does not interfere or minimally interferes with the steam from a steamer, for instance.

In an embodiment, the support surface comprises open frame attachment provisions at its circumference, at each side for stretching up said support surface within said open frame. In an embodiment the open frame attachment provisions may allow said support surface material to be stretched up in a taut way within said open frame. In an embodiment, both the support surface and the open frame are provided with cooperating attachment provisions. For example, the support surface can be provided with loops or openings, and the open frame can be provided with corresponding hooks.

In an embodiment, said open frame comprises a framework comprising a substantially rectangular tubular frame. In an embodiment the open frame may comprise a set of poles on a base at one end and provided with a coupling part at the opposite end, and said support surface extending between said poles. Alternatively, the support surface may comprise two layers of material, thus providing an envelope that covers the poles. In an embodiment, the material itself may comprise two or more layers in turn, as already explained above. The envelope material allows use on both sides. In this way, a piece of garment can be placed over the garment stand. For instance, a shirt can be put on like on a person. It can then be treated while not requiring rearrangement of the garment.

In one of the embodiments disclosed above, the open frame can be of a light weight construction of tubes and/or U-profiles.

The term "substantially" herein, or in "substantially consists", will be understood by the person skilled in the art. The term "substantially" may also include embodiments with "entirely", "completely", "all", etc. Hence, in embodiments the adjective substantially may also be removed. Where applicable, the term "substantially" may also relate to 90% or higher, such as 95% or higher, especially 99% or higher, even more especially 99.5% or higher, including 100%. The term "comprise" includes also embodiments wherein the term "comprises" means "consists of".

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

The devices or apparatus herein are amongst others described during operation. As will be clear to the person skilled in the art, the invention is not limited to methods of operation or devices in operation.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "to comprise" and its conjugations does not exclude the presence of elements or steps other than those stated in a claim. The article "a" or "an" preceding an element does not exclude the presence of a plurality of such elements. In the device claim enumerating several means, several of these means may be embodied by one and the same item of hardware. The mere fact that certain measures are recited in mutually different dependent claims does not indicate that a combination of these measures cannot be used to advantage.

The invention further applies to an apparatus or device comprising one or more of the characterizing features described in the description and/or shown in the attached drawings.

The various aspects discussed in this patent can be combined in order to provide additional advantages. Furthermore, some of the features can form the basis for one or more divisional applications.

BRIEF DESCRIPTION OF THE DRAWINGS

Embodiments of the invention will now be described, by way of example only, with reference to the accompanying schematic drawings in which corresponding reference symbols indicate corresponding parts, and in which.

The drawings 1A-2D are not necessarily to scale.

DETAILED DESCRIPTION OF THE EMBODIMENTS

Figure 1A:
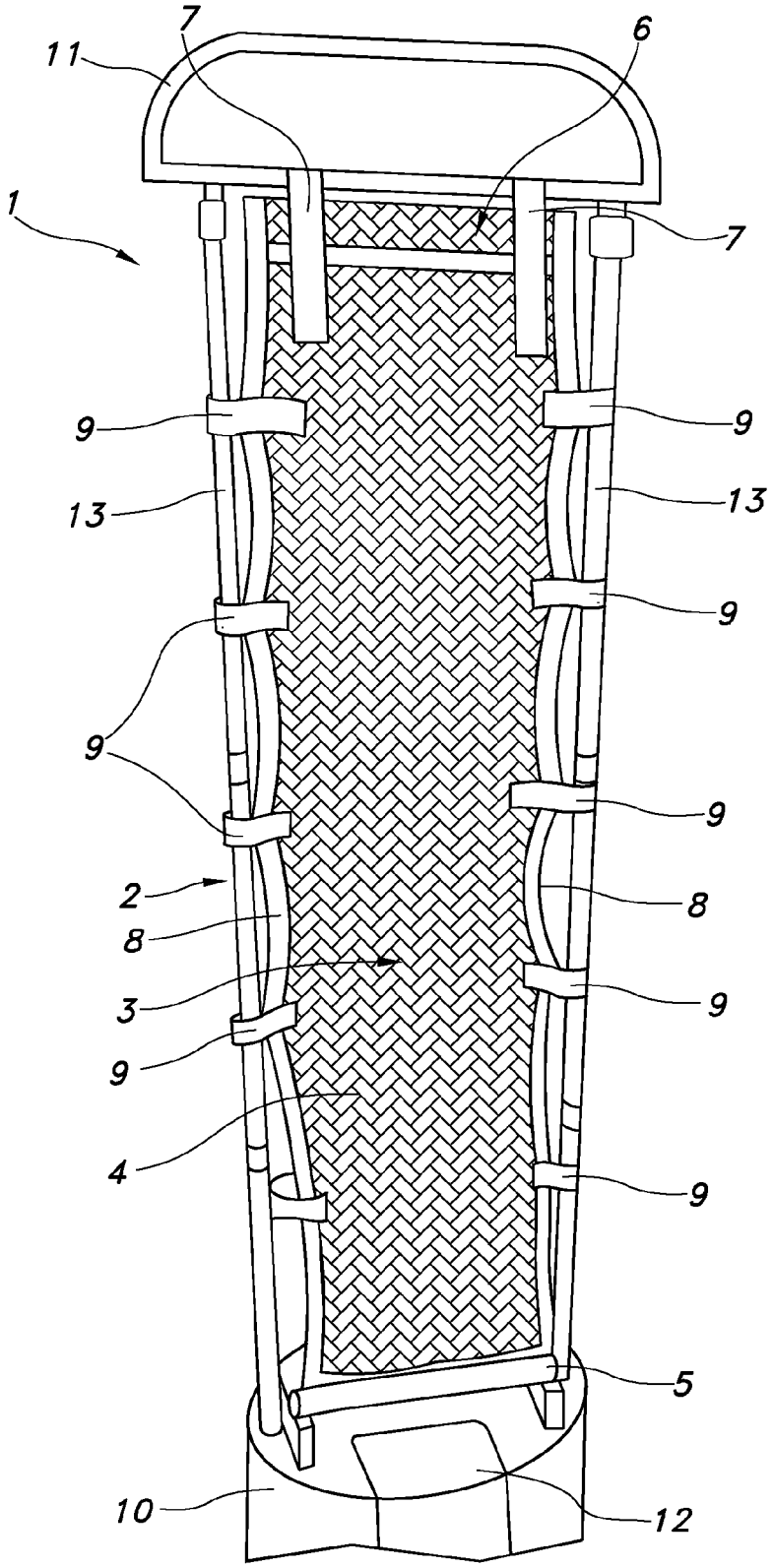
FIG. 1A shows an embodiment of a garment treatment stand.

FIG. 1A schematically depicts an illustration explaining the execution and working of one of the embodiments of the aforementioned invention. It shows a garment treatment stand 1 having an open frame 2, which here is an open frame 2, and a flexible, steam permeable support surface 3 mounted on said open frame 2. In FIG. 1A, the flexible, steam permeable support surface 3 is stretched up by said open frame 2.

In this embodiment of FIG. 1A, the open frame 2 is provided with a base 10 at one end. The base 10 allows said open frame 2 to be placed in a vertical orientation. In this embodiment, base 10 is provided with a garment treatment device 12, for instance a steamer, incorporated or integrated in the base 10.

At its opposite end, the open frame 2 is provided with an arrangement for holding garments 11. In an embodiment, the arrangement for holding garment 11 comprises a hanger. This provides a shoulder support for shirts and the like. Alternatively, that end of the open frame can be shaped substantially in the shape of a hanger. In an embodiment, further garment holding provisions 11 can be provided at or near that end of the open frame 2, for instance clips for holding garments, for instance the end of the legs of a trouser. FIGS. 2A-2D show such clips 11'.

Figure 1B:
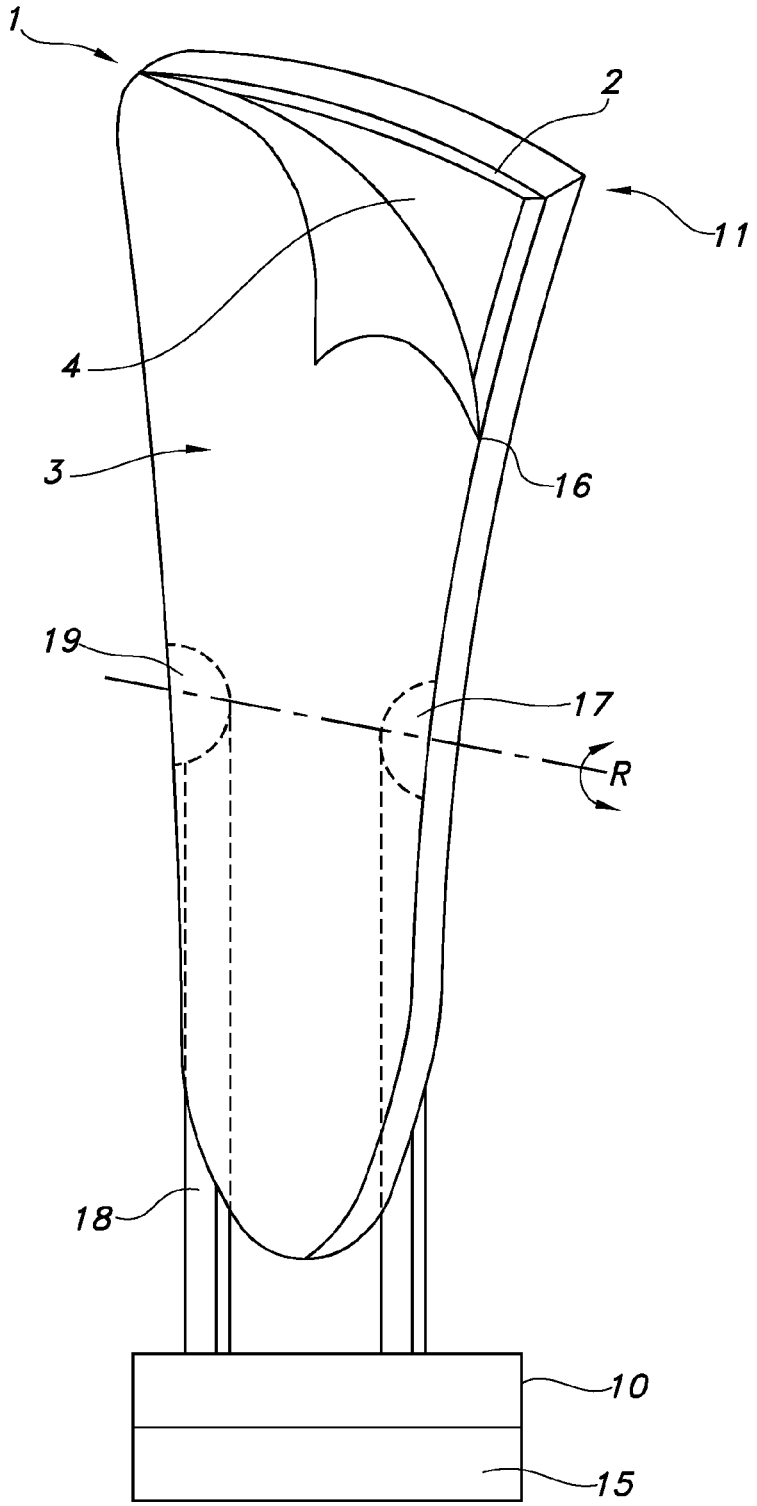
FIG. 1B shows an alternative embodiment of a garment stand.

In this embodiment of FIG. 1A, the open frame 2 comprises a framework, in particular a tubular frame, specifically a rectangular tubular frame. Here, the support surface 3 is mounted on the open frame 2 in such a way that it is stretched up within the open frame. Often, the flexible material used for the support surface 3 is stretchable and can stretch a little. Often, it is then stretched to such an extent that the flexible material provides a support surface provides a surface that can withstand some pressure. The support surface 3 in use is mounted on the open frame 2 in such a way that it allows applying pressure on garment that is provided on the garment stand 1 while ironing/steaming the garment. To that end, the material of the support surface 3 is stretched tautly, or in a taut manner. In the embodiment of FIG. 1, the open frame 2 has two opposite poles 13. These poles are attached at one end to the base 10, and at their other end they can be coupled by a cross bar or, as is the case in FIG. 1, via garment holder 11.

In an embodiment as schematically depicted here in FIG. 1A, the support surface 3 is a strip of flexible, steam permeable material 4 that is mounted on the open frame 2. In an embodiment, the support surface 3 can be removable from the open frame 2 in order to facilitate easy storage of the garment treatment stand 1 after usage. In the embodiment of FIG. 1, the support surface 3 comprises a strip, sheet, or band of flexible, steam permeable material 4 that can be rolled up. In the embodiment of FIG. 1A, the strip has opposite transverse sides and opposite longitudinal sides 8. These sides define the circumference of the strip. At the transverse sides, the strip of flexible, steam permeable material is provided with open frame attachment provisions 5, 7 for attaching the transverse sides to the open frame 2. In order to prevent constriction at the longitudinal sides 8, and to provided a better stretching of the support surface material, the longitudinal sides 8 are provided with open frame attachment provisions 9 for attaching the longitudinal sides 8 to the open frame 2. In this way, the support surface 3 is at its perimeter attached to the open frame 2. In an embodiment, these open frame attachment provisions 9 can cooperate with attachment provisions on the open frame 2. For instance, the longitudinal sides 8 can be provided with holes and the open frame 2 can be provided with corresponding hooks or bands. There band can be provided with Velcro for attachment of for making loops of these bands which can run through the holes.

In particular, in the embodiment of FIG. 1A, the support surface 3 is flexible in order to allow said support surface 3 to be rolled up. In the embodiment of FIG. 1, the garment treatment stand 1 is provided with a roll 5 that is rotatable about its longitudinal axis attached to one end of said garment treatment stand 1. In this embodiment, the roll is attached to the base 10 to provide stability. Other positions for attaching the roll 5 are possible. The roll 5 allows said support surface material to be rolled up in a roll. In an embodiment, the roll 5 is spring biased, so that the support surface material is rolled up on the roll 5 when said support surface 3 is further released from the open frame 2. This mechanism, as such, is known for window blinds and therefore needs no further explanation. The roll construction allows a swift attachment of the support surface. The roll 5 is optional. An other way of providing a removable support surface 3 is for instance providing the strip only with attachment provisions that allow attachment to the open frame. When the support surface is elongated, providing attachment provisions 9 only at the longitudinal sides 8 may be sufficient. Attachment provisions can be provided at or near the corners of the support surface 3. Alternatively, the strip can comprise ridged bars that may be removeably or permanently attached to the longitudinal sides 8 of the strip 3. Coupling these bars with the open frame 2 may already stretch the strip sufficiently.

At its opposite end 6, the support surface 3 is here provided with attachment provisions 7 for attaching the support surface material to an opposite end of the open frame 2. In an embodiment, the support surface 3 is for instance provided with openings and the open frame 2 is provided with corresponding hooks, to be received in the openings. Alternatively, the support surface 3 can be provided with hooks that can be hooked onto members of the open frame 2. The support surface 3 can also be provided with flexible strips with Velcro that can be strapped around members of the open frame 2. Thus, the support surface material can be fitted between the ends of the open frame 2.

In the embodiment of FIG. 1B, the open frame again may be an open frame 2. It thus comprises a peripheral frame that is hingingly coupled to base 10. This allows the open frame 2 with the support surface to rotate around axis R between the vertical position shown and a horizontal position, and to assume any angle in between. In this embodiment, the open frame 2 is provided with a layer of material at both sides for providing a supports surface. Both layers 4 are positioned at a distance from one another. In particular, here two layers 4 are attached to one another to provide an envelope of flexible material around a peripheral frame. The peripheral frame may comprise reinforcement provisions, for instance bars, within the peripheral fame.

In order to provide a support surface that is removable, the two layers 4 can be coupled to one another via closing provisions around the periphery of the support surface. In an embodiment, a zipper 16 can be provided to interconnect the layers. Thus, the support surface is easily removable and can be stretched around the peripheral frame. Alternative closing provisions can be provided, like buttons, hooks, Velcro, and the like.

The open frame 2 in this embodiment has an organic shape, providing a broader end 11 as a garment shoulder support. In this way, for instance shoulders of a shirt are supported. The open frame of FIG. 1B in fact can provide two surfaces allowing garment treatment without rearrangement of the garment. The open frame may even be of a yet more organic human torso shape in order to allow easy treatment of shirts.

The open frame 2 is hingingly coupled to the base 10 in this embodiment via poles 18. These poles 18 couple to said open frame 2 via hinging provisions 17 at both sides of the open frame 2, allowing in an embodiment said open frame to rotate almost 360 degrees. The hinging provisions 17 have locking provisions 19 for locking the open frame 2 in an angular position between vertical and horizontal. In an embodiment, the locking provisions allow the open frame to be locked in any angular position.

In this embodiment, the base 10 is provided with a storage 15 for the flexible support once removed from the open frame 2. Here, the base may also be provided with a garment treatment device 12, like a steamer, and/or for instance a water tank, that also provides additional stability.

Figures 2A, 2B, 2C, 2D:
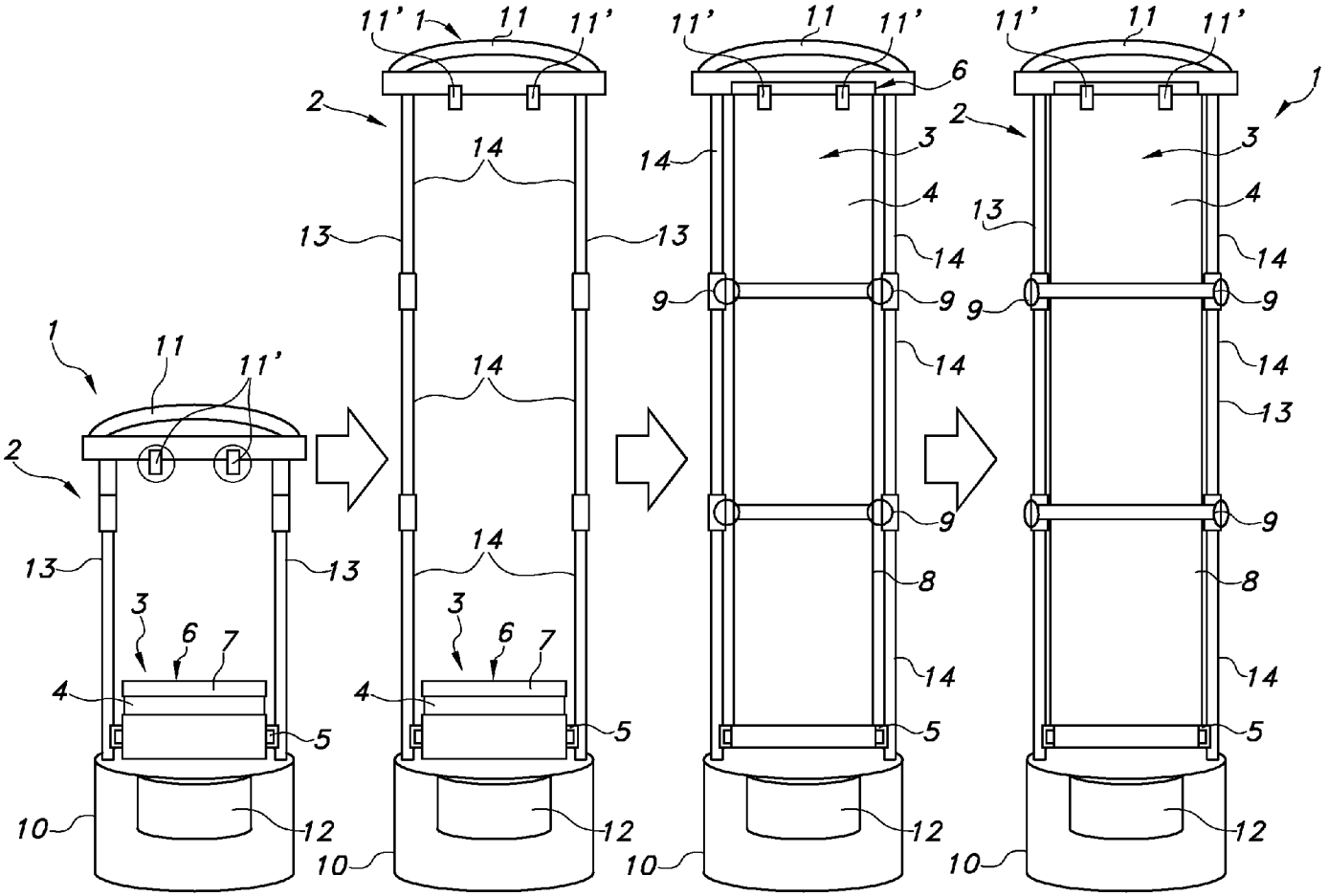
FIGS. 2A-2D shows yet an other alternative embodiment of a garment treatment stand.

In FIGS. 2A-2D, an embodiment of the current invention is provided in which the open frame 2 is a collapsible frame. In this embodiment, the open frame 2 again is an open frame and comprises two extendable or telescoping poles or posts 13. In this embodiment, ends of the poles 13 are again attached to the base 10. In FIG. 2A, the garment treatment stand 1 is shown in its collapsed state. And the support surface material is rolled up on roll 5. Thus, the garment treatment stand 1 can be stowed away easily. The invention is however not limited to collapsible frames.

In FIG. 2B, the poles 13, here telescoping poles 13 with pole elements 14, are fully extended. The support surface strip 4 is still in its rolled-up state on roll 5.

In FIG. 2C, the support surface material is in its extended state. The opposite end 6, opposite to the roll end, is now attached to an open frame end using the attachment provisions 7 discussed above. Here, the longitudinal attachment provisions 9 are not yet attached to the open frame.

In FIG. 2D, the longitudinal attachment provisions 9 are in fact attached to the open frame, in particular to the poles 13 of the open frame 2.

In the embodiment of FIGS. 1 and 2A-2D, the support surface material thus can be folded up in a 'roll' form, and this roll 5 may be anchored at the base 10 of the garment treatment stand. In FIGS. 2A-2D, the open frame 2 is collapsible. Once the open frame 2 is pulled up and fully extended, the rolled up support surface material can be pulled out too. Its free edge, opposite end 6, is then extended up all the way to a horizontal rod in the open frame 2, and using in this embodiment hooks present on the free edge, it is anchored to that rod. Since it is desired in this situation that the support surface material 4 is as taut as possible, the length of the material used in this embodiment is a little less than the distance the material has to travel between the base 10 and the top opposite end 6 of the open frame 2. The exact distance will be dependent on the elasticity of the material used. However, when the material is stretched vertically in this manner, it usually tends to shrink in its width, especially around the middle regions of the stretched part. This makes the material less taut in the horizontal direction (in use). In order to anchor the material in horizontal direction, in this embodiment hooks are provided at least at two opposing points down the length of the material to attach it to the open frame 2, here the poles 13 of the open frame 2. This ensures that the material is truly stretched in all directions, and is stable and wide enough to be used as a pressing surface.

Following this, a shirt can be put on the hanger stand as usual, and steamed against the surface. However, in an embodiment trouser clips can be added to the top of the open frame, so that the support surface can effectively be used as a pressing surface for pressing trousers/skirts etc., which usually is not quite possible in state of the art garment stands for steamers.

Figure 3:
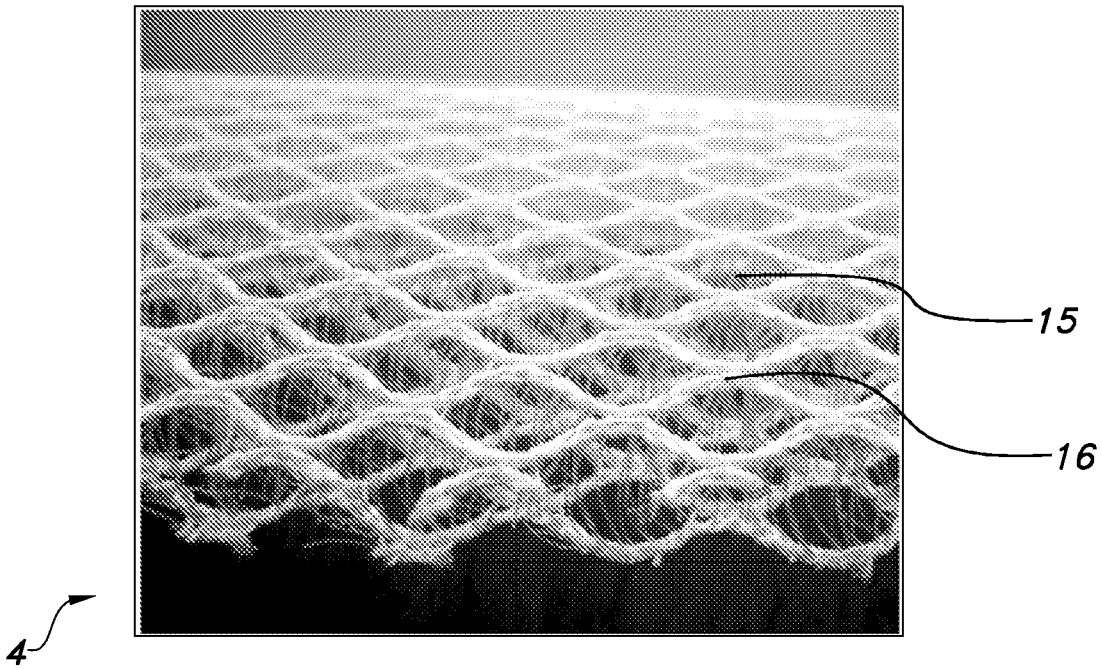
FIG. 3 shows an embodiment of a textile suitable for providing the support surface.

In FIG. 3 an example of a material that can be used for the support surface is shown in detail. The material shown is so called 3D fabric. It has openings 15 that are bounded by fabric 16.

The invention claimed is:

1. A garment treatment stand for garment treatment, the garment treatment stand comprising:

a base;

an open frame coupled to the base, wherein the open frame comprises a pair of spaced apart frame members configured to extend upwardly from the base; and a flexible support surface configured to be stretched taut between the pair of spaced frame members for providing a support surface for pressing against during garment treatment with an iron and/or hand-held garment steamer, wherein said support surface comprises a strip of steam permeable, flexible material, said strip of steam permeable, flexible material has longitudinal sides, and at its longitudinal sides said strip of steam permeable, flexible material is provided with further attachment provisions for attaching said strip of steam permeable, flexible material in a stretched manner to said open frame.

2. The garment treatment stand of claim 1, wherein said open frame leaves the area of the support surface open for at least 50% of the area.

3. The garment treatment stand of claim 1, wherein said flexible support surface comprises at least one porous layer.

4. The garment treatment stand of claim 1, wherein said flexible support surface is at least partially steam permeable.

5. The garment treatment stand of claim 1, wherein said flexible support surface is at least partially steam reflecting.

6. The garment treatment stand according to claim 1, wherein said support surface comprises a layer selected from the group consisting of a 3D fabric, an open cell material, a mesh fabric, and a net-like fabric, or a combination thereof.

7. The garment treatment stand according to claim 1, wherein said flexible support surface is removable from said open frame.

8. The garment treatment stand according to claim 1, further comprising a storage for said support surface.

9. The garment treatment stand according to claim 8, wherein the support surface comprises a strip of steam permeable, flexible material, at one end mounted on a roll provided at an end of said open frame and configured to be wound around said roll in a non-extended state and to be at least partially unwound from the roll in an extended state extending to an opposite end of said open frame.

10. The garment treatment stand according to claim 9, wherein said support surface comprises open frame attachment provisions at its circumference, for stretching up said support surface within said open frame, in particular stretched up in a taut way within said open frame.

11. A garment treatment stand for garment treatment, comprising:

a base;

an open frame coupled to the base, wherein the open frame comprises a pair of spaced apart frame members configured to extend upwardly from the base;

a flexible support surface configured to be stretched taut between the pair of spaced frame members for providing a support surface for pressing against during garment treatment with an iron and/or hand-held garment steamer; and a storage for said support surface, wherein the support surface comprises a strip of steam permeable, flexible material, at one end mounted on a roll provided at an end of said open frame and configured to be wound around said roll in a non-extended state and to be at least partially unwound from the roll in an extended state extending to an opposite end of said open frame, wherein said strip of steam permeable, flexible material has longitudinal sides, and at its longitudinal sides said strip of steam permeable, flexible material is provided with further attachment provisions for attaching said strip of steam permeable, flexible material in a stretched manner to said open frame.

12. The garment treatment stand of claim 9, wherein said support surface is a textile layer.

13. The garment treatment stand according to claim 1, wherein the support surface is stowable.

14. The garment treatment stand of claim 1, wherein said open frame leaves the area of the support surface open for at least 90% of the area.

* * * * *